US006117832A

United States Patent [19]

Chweh

[11] Patent Number: 6,117,832

[45] Date of Patent: Sep. 12, 2000

[54] AQUEOUS CLEANING SOLUTION COMPRISING NONYLPHENOXY POLY(ETHYLENEOXY)ETHANOL AND DINONYLPHENOXY POLY(ETHYLENEOXY)ETHANOL

[75] Inventor: Andrew Chweh, Park Ridge, Ill.

[73] Assignee: AJ Prospect Laboratories, Inc., Park Ridge, Ill.

[21] Appl. No.: 09/416,990

[22] Filed: Oct. 13, 1999

[30] Foreign Application Priority Data

Sep. 10, 1999 [KR] Rep. of Korea ..... 99-38683

[51] Int. Cl.[7] ..... C11D 17/00

[52] U.S. Cl. ..... 510/352; 510/356; 510/357; 510/421; 510/422; 510/428; 510/505

[58] Field of Search ..... 510/352, 356, 510/357, 421, 422, 428, 505

*Primary Examiner*—Necholus Ogden
*Attorney, Agent, or Firm*—Mark E. Wiemelt

[57] ABSTRACT

The aqueous cleaning solution of the present invention comprises triethanolamine dodecylbenzene sulfonate, nonylphenoxy poly(ethyleneoxy)ethanol, triethanolamine lauryl sulfate, dinonylphenoxy poly(ethyleneoxy)ethanol, and sodium xylene sulfonate. The instant aqueous cleaning solution preferably comprises 1.6±0.16 pounds per gallon of triethanolamine dodecylbenzene sulfonate, 0.5±0.05 pounds per gallon of nonylphenoxy poly(ethyleneoxy)ethanol 0.5±0.05 pounds per gallon of triethanolamine lauryl sulfate. 0.6±0.06 pounds per gallon of dinonylphenoxy poly (ethyleneoxy)ethanol, and 0.4±0.04 pounds per gallon of sodium xylene sulfonate.

3 Claims, No Drawings

AQUEOUS CLEANING SOLUTION COMPRISING NONYLPHENOXY POLY (ETHYLENEOXY)ETHANOL AND DINONYLPHENOXY POLY(ETHYLENEOXY) ETHANOL

FOREIGN PRIORITY

This is a nonprovisional application claiming priority from a Korean patent application having Application Number 10-1999-38683 and a filing date of Sep. 10, 1999 that was filed in The Korea Industrial Property Office located in Seoul, Republic of Korea. This claim for foreign priority is based on 35 U.S.C. § 119 and the Paris Convention for the Protection of Industrial Property, to which the Republic of Korea is a member.

FIELD OF THE INVENTION

This invention relates to liquid detergents used in the laundry cleaning industry. In particular, this invention is for an improved aqueous cleaning solution that is more effective than existing detergents.

BACKGROUND OF THE INVENTION

Numerous cleaning detergents are used in the laundry cleaning business. Different detergents and cleaning methods are used to clean clothing with varying results. When a detergent does not fully clean clothing the first time laundromats must wash the clothing a second time or multiple times, depending on the efficacy of the detergents. It is also typical for laundromats to use bleaches to whiten white clothing and to brighten colored clothing, in addition to cleaning with a detergent. To counteract the harmful effects of bleach., neutralizing agents must be used during the cleaning process. And, if the bleach does not clean well enough, it is customary for laundromats to scrub or brush clothing for a deeper clean. This is especially true for areas such as the collar or the cuff of blouses and shirts. Additionally, chemicals treatments are used to remove soil embedded in clothing.

All of these cleaning detergents and techniques are harmful to the clothing and cause the fabric of the clothing to weaken, thereby decreasing the "life" of the clothing. Furthermore, bleaches, neutralizing agents and chemical treatments typically leave residue on the clothing that may irritate the wearer's delicate skin. This is especially harmful to people who are allergic to chemicals and bleaches. Hence, the existing detergents and techniques used in the art have a host of disadvantages and unwanted side-effects.

BRIEF SUMMARY OF THE INVENTION

The present invention is for an aqueous cleaning solution that may be used in both the laundry cleaning industry and the consumer sector. The instant aqueous cleaning solution comprises triethanolamine dodecylbenzene sulfonate, nonylphenoxy poly(ethyleneoxy)ethanol, triethanolamine lauryl sulfate, dinonylphenoxy poly(ethyleneoxy)ethanol, and sodium xylene sulfonate. Optimal ranges of each compound used in the aqueous cleaning solution comprise from 1.44 to 1.76 pounds per gallon of triethanolamine dodecylbenzene sulfonate, from 0.45 to 0.55 pounds per gallon of nonylphenoxy poly(ethyleneoxy)ethanol from 0.45 to 0.55 pounds per gallon of triethanolamine lauryl sulfate, from 0.54 to 0.66 pounds per gallon of dinonylphenoxy poly (ethyleneoxy)ethanol, and from 0.36 to 0.44 pounds per gallon of sodium xylene sulfonate. The most preferred amount of each compound used in the aqueous cleaning solution comprises 1.6 pounds per gallon of triethanolamine dodecylbenzene sulfonate, 0.5 pounds per gallon of nonylphenoxy poly(ethyleneoxy)ethanol, 0.5 pounds per gallon of triethanolamine lauryl sulfate, 0.6 pounds per gallon of dinonylphenoxy poly(ethyleneoxy)ethanol, and 0.4 pounds per gallon of sodium xylene sulfonate.

The aqueous cleaning solution of the instant invention cleans clothing more effectively than existing detergents and thus dramatically decreases the need to use additional detergents or soaps, strong chemical solutions, bleaches and neutralizing agents, or to utilize other cleaning techniques, such as brushing or scrubbing. The result is that clothing cleaned with the novel aqueous cleaning solution will be whiter and brighter, with less effort expended than when using existing detergents and cleaning methods. Another benefit of the present invention is that the aqueous cleaning solution does not irritate human skin. Further, less time is used—such as the time required for an extra wash or for scrubbing/brushing of the clothing—to clean clothing when the aqueous cleaning solution of the instant invention is used, resulting in more clothes being cleaned in the same time frame. This results in faster turn-around time, ensuring that customers will receive their cleaned clothing faster than with existing cleaning detergents and methods. The faster turn-around time, in turn, leads to more profits for the laundromat because more clothing can be cleaned, and at a faster rate, when the present liquid detergent is used. Another benefit of the instant invention is that the cost of cleaning clothing will decrease, due to the fact that less time, energy and money are required to clean the clothing; this results in monetary savings for the user. Consequently, the cost of supplies needed to run a laundromat business are also substantially decreased.

It is, therefore, an object of the present invention to teach a novel aqueous cleaning solution that cleans better than existing detergents and cleaning techniques.

It is also an object of the present invention to teach an aqueous cleaning solution that cleans effectively without having to use additional detergents, soaps, bleaches or chemicals.

A further object of the instant invention is to teach an aqueous cleaning solution that is not irritable to human skin.

Another object of the present invention is to teach an aqueous cleaning solution that saves cleaning time, energy and costs.

It is also an object of the present invention to teach an aqueous cleaning solution that does not decrease the life of, or cause harm to, the clothing being cleaned.

There has thus been outlined, rather broadly, the more important features of the invention in order that the detailed description thereof that follows may be better understood, and in order that the present contribution to the art may be better appreciated. There are, of course, additional features of the invention that will be described hereinafter and that will form the subject matter of the invention. Those skilled in the art will appreciate that the conception, upon which this disclosure is based, may readily be utilized as a basis for the designing of other devices for carrying out the several purposes of the present invention. It is important, therefore, that the invention be regarded as including such equivalent constructions insofar as they do not depart from the spirit and scope of the present disclosure.

BRIEF DESCRIPTION OF THE SEVERAL VIEWS OF THE DRAWINGS

Not Applicable.

DETAILED DESCRIPTION OF THE INVENTION

The present invention is for an aqueous cleaning solution used to clean clothing. The instant aqueous cleaning solution comprises triethanolamine dodecylbenzene sulfonate, nonylphenoxy poly(ethyleneoxy)ethanol, triethanolamine lauryl sulfate, dinonylphenoxy poly(ethyleneoxy)ethanol, and sodium xylene sulfonate. In a preferred embodiment of the present invention, the aqueous cleaning solution comprises from 1.44 to 1.76 pounds per gallon of triethanolamine dodecylbenzene sulfonate, from 0.45 to 0.55 pounds per gallon of nonylphenoxy poly(ethyleneoxy)ethanol, from 0.45 to 0.55 pounds per gallon of triethanolamine lauryl sulfate, from 0.54 to 0.66 pounds per gallon of dinonylphenoxy poly(ethyleneoxy)ethanol, and from 0.36 to 0.44 pounds per gallon of sodium xylene sulfonate.

In the most preferred embodiment of the instant invention, the aqueous cleaning solution comprises 1.6 pounds per gallon of triethanolamine dodecylbenzene sulfonate. 0.5 pounds per gallon of nonylphenoxy poly (ethyleneoxy)ethanol, 0.5 pounds per gallon of triethanolamine lauryl sulfate, 0.6 pounds per gallon of dinonylphenoxy poly(ethyleneoxy)ethanol, and 0.4 pounds per gallon of sodium xylene sulfonate.

The compounds that comprise the aqueous cleaning solution are commercially available in liquid form. In formulating the cleaning detergent solution of the present invention, all of compounds are measured to the preferred weight (in pounds) and, then, poured into a one-gallon container. For instance, in the most preferred embodiment, the measurements for the compounds comprise 1.6 pounds of triethanolamine dodecylbenzene sulfonate, 0.5 pounds of nonylphenoxy poly(ethyleneoxy)ethanol, 0.5 pounds of triethanolamine lauryl sulfate, 0.6 pounds of dinonylphenoxy poly(ethyleneoxy)ethanol, and 0.4 pounds of sodium xylene sulfonate. After the compounds are poured into the one-gallon container, water is poured into the same container to make one gallon of the aqueous cleaning solution.

The one-gallon of aqueous cleaning solution formulated above is, then, ready for use. In a typical load of laundry, approximately 10 pounds of clothing are washed at any one time. To clean the load of laundry with the novel aqueous cleaning solution, approximately 1 ounce of the pre-made solution is poured into the washing machine. In this conventional way, the aqueous cleaning solution of the present invention is utilized to clean a typical load of laundry.

While the invention has been described in connection with a preferred embodiment, it will be understood that it is not intended that the invention be limited to that embodiment. On the contrary, it is intended to cover all alternatives, modifications and equivalents as may be included within the spirit and scope of the invention as disclosed.

As to the manner of usage and operation of the instant invention, same should be apparent from the above disclosure, and accordingly no further discussion relevant to the manner of usage and operation of the instant invention shall be provided.

Therefore, the foregoing is considered illustrative of only the principles of the invention. Further, since numerous modifications and changes will readily occur to those skilled in the art, it is not desired to limit the invention to the exact composition described and accordingly, all suitable modifications and equivalents may be resorted to, falling within the scope of the invention.

What is claimed is:

1. An aqueous cleaning solution, comprising:

(a) triethanolamine dodecylbenzene sulfonate;

(b) nonylphenoxy poly(ethyleneoxy)ethanol;

(c) triethanolamine lauryl sulfate;

(d) dinonylphenoxy poly(ethyleneoxy)ethanol; and (e) sodium xylene sulfonate.

2. An aqueous cleaning solution, comprising:

(a) triethanolamine dodecylbenzene sulfonate, from 1.44 to 1.76 pounds per gallon;

(b) nonylphenoxy poly(ethyleneoxy)ethanol, from 0.45 to 0.55 pounds per gallon;

(c) triethanolamine lauryl sulfate, from 0.45 to 0.55 pounds per gallon;

(d) dinonylphenoxy poly(ethyleneoxy)ethanol, from 0.54 to 0.66 pounds per gallon; and (e) sodium xylene sulfonate, from 0.36 to 0.44 pounds per gallon.

3. An aqueous cleaning solution, comprising:

(a) 1.6 pounds per gallon of triethanolamine dodecylbenzene sulfonate;

(b) 0.5 pounds per gallon of nonylphenoxy poly (ethyleneoxy)ethanol;

(c) 0.5 pounds per gallon of triethanolamine lauryl sulfate;

(d) 0.6 pounds per gallon of dinonylphenoxy poly (ethyleneoxy)ethanol; and (e) 0.4 pounds per gallon of sodium xylene sulfonate.

* * * * *